US005197706A

United States Patent [19]

Braithwaite et al.

[11] Patent Number: 5,197,706

[45] Date of Patent: Mar. 30, 1993

[54] SECURITY MOUNT

[75] Inventors: Robert F. Braithwaite, Levittown; Lawrence E. Schoenfelder, West Islip; Sheldon Wiederman, Setauket, all of N.Y.

[73] Assignee: Grumman Aerospace Corporation, Bethpage, N.Y.

[21] Appl. No.: 711,898

[22] Filed: Jun. 7, 1991

[51] Int. Cl.[5] ..... E05B 73/00

[52] U.S. Cl. ..... 248/499; 70/58

[58] Field of Search ..... 248/499, 551, 552, 553; 70/58, 57, 232, 231, 229, 230; 211/4

[56] References Cited

U.S. PATENT DOCUMENTS

| | | | |
|---|---|---|---|
| 3,859,826 | 1/1975 | Singer et al. | 70/58 |
| 4,212,175 | 7/1980 | Zakow | 70/58 |
| 4,223,542 | 9/1980 | Basseches | 248/553 X |
| 4,300,371 | 11/1981 | Herwick et al. | 248/553 X |
| 4,655,429 | 4/1987 | Gaenzle et al. | 248/553 |
| 4,733,840 | 3/1988 | D'Amore | 70/58 X |
| 4,856,305 | 8/1989 | Adams | 70/58 |
| 4,979,382 | 12/1990 | Perry | 70/232 X |
| 5,050,836 | 9/1991 | Makous | 248/553 |

*Primary Examiner*—Karen J. Chotkowski
*Attorney, Agent, or Firm*—Bacon & Thomas

[57] ABSTRACT

A security mount for securing at least one piece of equipment to a surface includes a mounting plate which is mounted onto each piece of equipment for engaging a tension cable. The mounting plate contains an outwardly projecting portion which contains a channel for receiving one end of a tension cable therethrough. The end of the tension cable is fixedly attached to a ballstop which has a diameter greater than that of the channel. The ballstop prevents the end of the cable from slipping back through the channel to provide a secure attachment thereto while imparting to it complete freedom of movement. The opposite end of the cable contains an eyelet which is fixedly attached by a bolt disposed between a pair of coupled plates. The bolt only can be accessed by uncoupling the plates. The plates are attached to a surface from below the surface by a mounting bolt which extends through the surface and through an aperture in the first plate, and which is threaded into the second plate. Access to the mounting bolt can be restricted, for example in the case where the surface is a desk top and the mounting bolt is threaded from a locked drawer, thereby completely preventing a thief from gaining access to the plate and cable mounting bolts. A single pair of coupled plates can be used to secure a plurality of cables.

7 Claims, 3 Drawing Sheets

SECURITY MOUNT

FIELD OF THE INVENTION

The present invention relates generally to security mounts used for theft prevention, and, more particularly, to security mounts for securing at least one piece of equipment to a surface.

BACKGROUND OF THE INVENTION

Security mounts of the above-mentioned general type are known in the art. For example, U.S. Pat. No. 4,655,429 discloses a security mount which uses epoxy adhesives and a tension cable to secure a computer and a peripheral piece of equipment to a surface. The security mount includes a first pad which is fixedly attached to a surface and is coated with an epoxy adhesive for holding a computer in a stationary position. A second pad is bolted at a single point onto the peripheral piece of equipment. The peripheral piece of equipment is tethered to the surface by using a tension cable to connect the second pad to an overhang portion located on the first pad.

Security mounts in the prior art, such as the one disclosed in the above-discussed patent, have a number of disadvantages. First, the method of mounting equipment in a stationary position onto a surface limits both the flexibility and accessibility of that piece of equipment, and thereby interferes with a user's ability to effectively operate the equipment in an efficient manner. In addition, security mounts of this type prove to be unduly burdensome in that they restrict the freedom of movement of the equipment during its re-location and repair.

Second, security mounts disclosed in the prior art require a separate mount for each piece of equipment to be protected. This is not only inconvenient, but also requires a number of suitable mounting surfaces to be found, increasing the probability that the surface to which the mount is secured is inadequate, or that the equipment will be left unprotected because insufficient space is available for all of the necessary security mounts.

Third, in cases where the tethering cable is attached by mounting hardware, such as bolts, the hardware is left exposed, making it easy for a thief to remove the mounting hardware, and therefore the tethering cable, from the pads to which it is attached. Finally, the use of epoxy adhesives is itself an ineffective method for securing pieces of equipment to a surface. Therefore, a need exists to overcome the above-mentioned disadvantages by providing a security mount with an enhanced capability to secure equipment against theft, while providing greater flexibility and mobility of the equipment during its use, relocation and repair.

SUMMARY OF THE INVENTION

Accordingly, it is a principal objective of the present invention to provide an improved security mount which is capable of providing greater flexibility of equipment when in use.

It is a further objective of the present invention to provide an improved security mount which does not restrict the mobility and accessibility of equipment during its use and re-location.

It is still a further objective of the present invention to provide an improved security mount which permits multiple pieces of equipment to be secured from a single location.

It is yet another objective of the present invention to provide an improved security mount which is inexpensive, easy to install and configured to allow for controlled disassembly of equipment during repair.

Finally, it is also another objective of the present invention to provide an improved security mount in which all mounting hardware is hidden from view, and in which a cable is attached to a first plate by hardware which can only be accessed after first removing a second plate which covers the first plate and the cable attachment hardware.

The foregoing and other objects of the invention are achieved by providing an improved security mount which secures at least one piece of equipment to a surface by using an innovative ballstop attachment design. The security mount includes at least one cable mounting plate which is advantageously mounted onto each piece of equipment for engaging a tension cable. Each mounting plate contains an outwardly projecting portion which contains a channel for receiving one end of a tension cable therethrough. The end of the tension cable is fixedly attached to a ballstop which has a diameter greater than that of the channel. The ballstop allows the cable to flexibly engage the piece of equipment by preventing the end of the cable from slipping back through the channel, while at the same time imparting to it complete freedom of movement during its use and repair.

In an especially advantageous embodiment of the invention, the opposite end of the cable is secured between a pair of coupled plates which are fixedly attached to the surface by a lock. The first and second plates are secured to a table top or other suitable surface by a bolt from below the surface, the mounting bolt for the cable being threaded in to the first plate and covered by the second plate, leaving no exposed mounting bolts. The second plate contains multiple cable recesses for permitting more than one piece of equipment to be secured from a single location, or the use of multiple cables to secure a single piece of equipment, thus providing additional protection from theft.

BRIEF DESCRIPTION OF THE DRAWINGS

The preferred embodiments are described with reference to the drawings in which.

DESCRIPTION OF THE PREFERRED EMBODIMENTS

Figure 1:
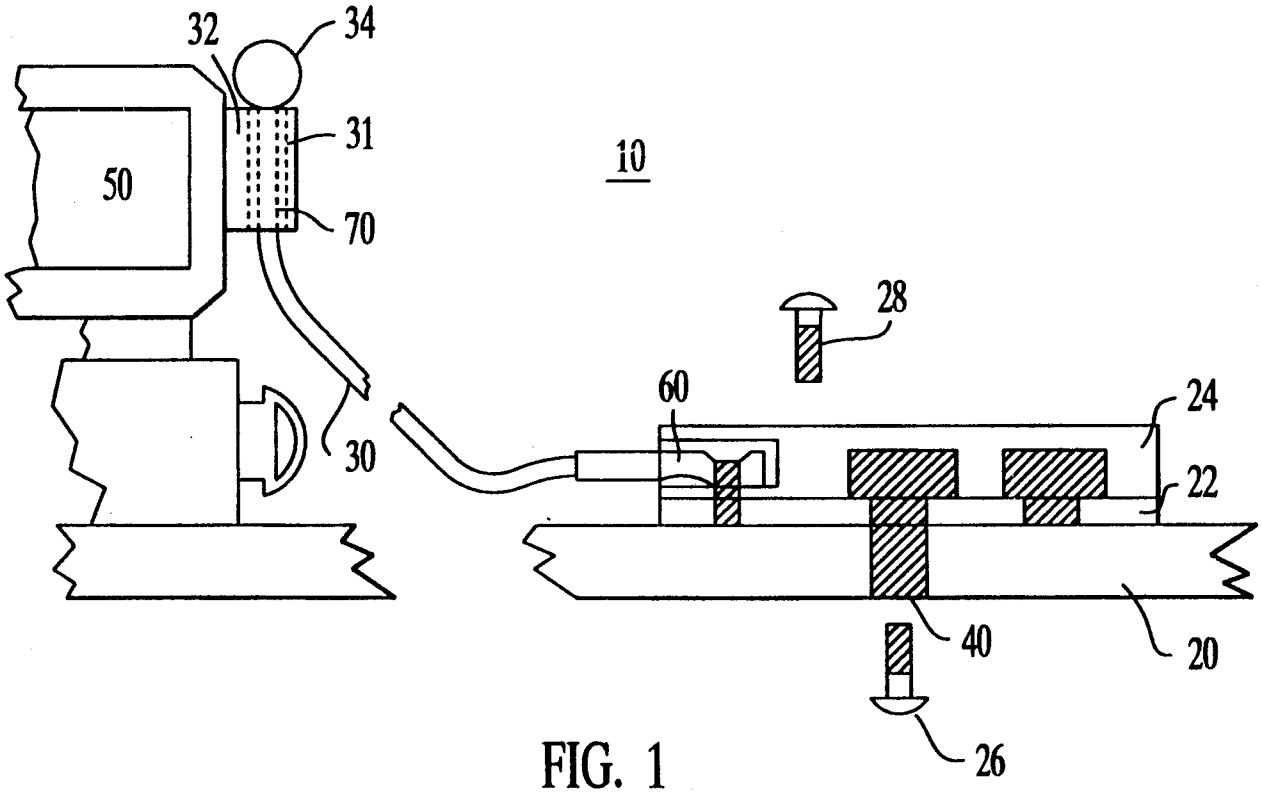
FIG. 1 is a diagrammatic view of the security mount in accordance with the present invention.

Referring to FIG. 1, a security mount according to the present invention is shown generally at 10.

Figure 2:
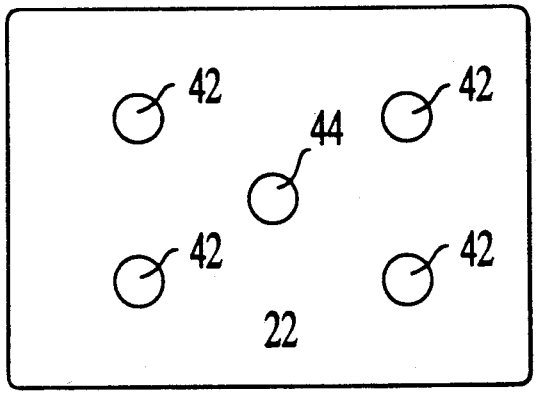
FIG. 2 is a diagrammatic top elevation view of the desk plate in accordance with the present invention.

A desk plate 22, as shown in FIG. 2, contains a mounting aperture 44 disposed therethrough and a plurality of retaining apertures 42 disposed into the plate to a predetermined depth. Each retaining aperture 42 is threaded for accepting a mounting bolt.

Figure 3:
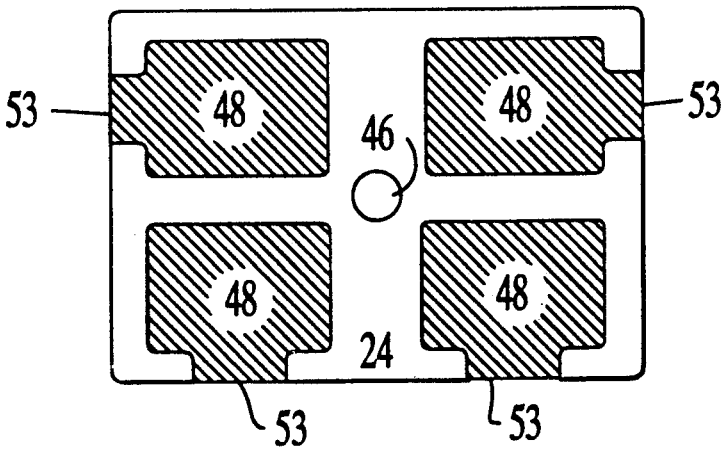
FIG. 3 is a diagrammatic bottom elevation view of the capping plate in accordance with the present invention.

A capping plate 24, as shown in FIG. 3, contains a mounting aperture 46 and four cutout portions 48, all of which are disposed a predetermined depth into capping plate 24. Cutout portions 48 are disposed in opposing relation to and are in communication with retaining apertures 42 in desk plate 22. Cutout portions 48 each contain a mouth 53 which provides an inlet/outlet for receiving a cable 30. Capping plate 24 and desk plate 22 preferably are of equal dimensions and contain the same number retaining apertures and cutout portions. Although the specific embodiment of the present invention shown in FIG. 3 depicts four cutout portions, it will be appreciated that a different number could be provided. In addition, the cutout portions could be provided, instead, in desk plate 22, or, alternatively, communicating recesses could be provided in both plates.

In operation, capping plate 24 is disposed adjacent to desk plate 22 so that mounting apertures 44 and 46 and retaining apertures 42 and cutout portions 48 are in exact vertical alignment with one another. A lock 26 is inserted into an aperture 40 in surface 20, through unthreaded mounting aperture 44 of desk plate 22 and into the threaded mounting aperture 46 of capping plate 24 to operatively lock desk plate 22 and capping plate 24 onto a surface 20. Preferably, lock 26 is a threaded round-head bolt which is tightened into place by using, for example, a six-sided socket key (not shown).

A mounting plate 32 is fixedly attached to a piece of equipment 50 to be protected from theft. Mounting plate 32 contains a channel 31 of a predetermined diameter. A plurality of mounting plates may be fixedly attached to each piece of equipment to provide enhanced security against theft. The piece of equipment 50 may be a microcomputer, video equipment, typewriter, fax machine, etc.

Figure 4:
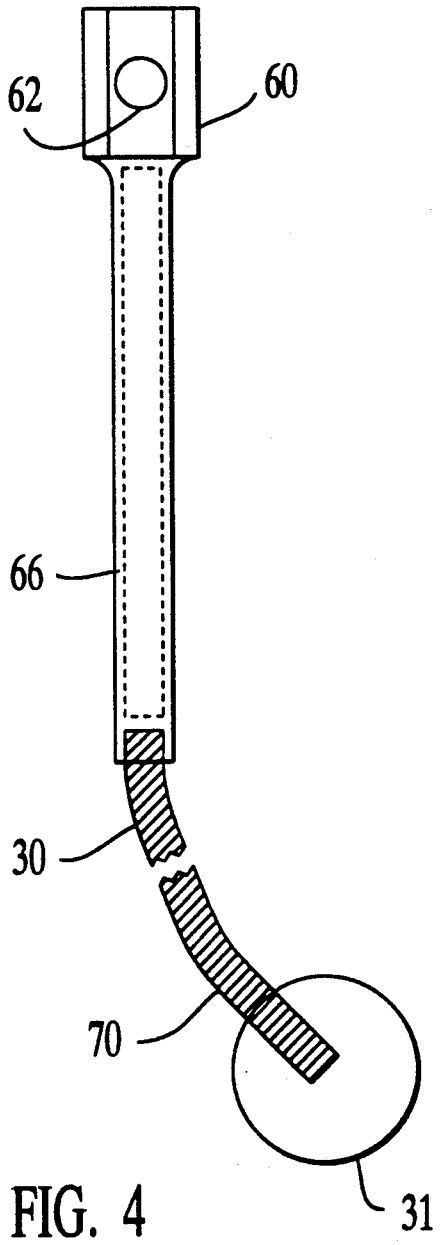
FIG. 4 is a diagrammatic view of the cable in accordance with the present invention.

As shown in FIG. 4, a cable 30 is used to tether each piece of equipment 50 to surface 20. Cable 30 contains a first end 60 which comprises an eyelet 62. Eyelet 62 is connected to a rotatable steel pin 66. Prior to bolting capping plate 24 and desk plate 22 to surface 20, cable 30 is fixedly attached to desk plate 22, and therefore surface 20, by inserting a threaded mounting bolt 28 through eyelet 62 and tightening it into the threads of a retaining aperture 42 in desk plate 22. Then, capping plate 24 is secured to desk plate 22 threaded mounting bolt 28 operates to secure cable 30 between capping plate 24 and desk plate 22 from below by lock 26, covering bolt 28 and leaving no exposed bolts which could be easily accessed by a thief. If the surface is, for example, a desk top, the lower opening of hole 40 could be located in a locked drawer, thereby completely preventing unauthorized access to lock 26. Cable 30 is constructed, preferably, from quarter-inch thick, 7-stranded aircraft cable, although numerous other cable constructions may be used.

Cable 30 contains a second end 70 which is inserted through channel 31 in mounting plate 32 and then fixedly attached to a ballstop 34. Ballstop 34 has a diameter which is greater than the diameter of channel 31 so that the second end is fixedly attached to the piece of equipment. Ballstop 34 is made, for example, from lead or high-impact plastic.

Cable 30 is cut at such a length as to allow complete freedom of movement of all pieces of equipment attached thereto. One or a plurality of cables may be attached to the same piece of equipment to provide added security against theft, or one cable may be used for each piece of equipment, eliminating the need for separate security mounts for each piece of equipment, while allowing one piece to be replaced without replacing the entire mount.

Other modifications and variations to the invention will be apparent to those skilled in the art from the foregoing disclosure. Thus, while only certain embodiments of the invention have been specifically described herein, it will be appreciated that the invention should not be limited by the above description, but rather should be limited solely by the appended claims.

What is claimed is:

1. A security mount for securing at least one piece of equipment to a surface, comprising:

a first plate having a mounting aperture and a plurality of retaining apertures;

a second plate having a complementary mounting aperture;

means defining at least one cutout portion in at least one of said two plates for receiving connecting means for connecting the at least one piece of equipment to said first and second plates, said cutout portion being disposed to be in communication with the retaining apertures in said first plate and having a mouth which extends outwardly therefrom and opens along a peripheral edge of said at least one of said two plates;

plate attachment means extending through said surface for attaching said first and second plates to each other and to the surface;

securing means extending through said retaining apertures for securing said connecting means to said first plate;

wherein said securing means is sandwiched between said first and second plates, said connecting means extending through said mouth; and wherein said securing means can be accessed by loosening said plate attachment means to thereby detach said second plate from said first plate.

2. A security mount as specified in claim 1, further comprising at least one mounting plate which is fixedly attached to said piece of equipment, and ballstop means for movably securing said connecting means to said mounting plate.

3. A security mount according to claim 2, wherein said connecting means is a cable and said securing means is a bolt which extends through an eyelet in a first end of said cable and which is threaded into said retaining aperture to secure said eyelet to said first plate, said eyelet and bolt being disposed in said cutout portion such that said cable extends from said cutout portion through said mouth.

4. A security mount according to claim 3, wherein said mounting plate includes a channel having a predetermined diameter for accepting a second end of said cable, said second end passing through said channel and being connected to a ballstop having a diameter greater than the diameter of said channel.

5. A security mount as specified in claim 1, wherein said plate attachment means includes a lock which is disposed in the mounting apertures of said first and second plates.

6. A security mount according to claim 5, wherein said lock is a bolt which extends through said surface and through said mounting aperture in said first plate, and which is threaded into said mounting aperture in said second plate to secure said first and second plates to said surface.

7. A security mount as specified in claim 1, further comprising a second cutout portion, retaining aperture and securing means for securing a second connecting means to said first plate.

* * * * *